US009120345B2

(12) United States Patent
Kim et al.

(10) Patent No.: US 9,120,345 B2
(45) Date of Patent: Sep. 1, 2015

(54) PRINTER FOR AUTOMATIC PACKING MACHINE AND METHOD OF CONTROLLING THE SAME

(75) Inventors: Jun Ho Kim, Daegu (KR); Tae Hwan Sung, Seoul (KR)

(73) Assignee: JVM Co., Ltd., Daegu (KR)

( * ) Notice: Subject to any disclaimer, the term of this patent is extended or adjusted under 35 U.S.C. 154(b) by 196 days.

(21) Appl. No.: 13/151,999

(22) Filed: Jun. 2, 2011

(65) Prior Publication Data

US 2011/0299907 A1 Dec. 8, 2011

(30) Foreign Application Priority Data

Jun. 3, 2010 (KR) ..... 10-2010-0052246
Jun. 3, 2010 (KR) ..... 10-2010-0052247

(51) Int. Cl.

| | |
|---|---|
| ***B41J 17/02*** | (2006.01) |
| ***B41J 17/32*** | (2006.01) |
| ***B41J 33/16*** | (2006.01) |
| ***B41J 33/32*** | (2006.01) |
| ***B41J 33/34*** | (2006.01) |
| ***B41J 33/36*** | (2006.01) |
| ***B41J 35/28*** | (2006.01) |

(52) U.S. Cl.

CPC *B41J 35/28* (2013.01); *B41J 17/02* (2013.01); *B41J 17/32* (2013.01); *B41J 33/16* (2013.01); *B41J 33/32* (2013.01); *B41J 33/34* (2013.01); *B41J 33/36* (2013.01)

(58) Field of Classification Search

CPC ..... B41J 2202/31
USPC ..... 400/120.16, 124.09, 205.1, 206.2, 211, 400/212, 214; 347/198
See application file for complete search history.

(56) References Cited

U.S. PATENT DOCUMENTS

| | | | | |
|---|---|---|---|---|
| 5,063,394 | A * | 11/1991 | Nagato | 347/187 |
| 5,088,846 | A * | 2/1992 | Yamaguchi | 400/208 |
| 5,145,269 | A * | 9/1992 | Matsuda et al. | 400/216.2 |
| 5,490,638 | A * | 2/1996 | Driftmyer et al. | 242/421 |
| 5,915,860 | A * | 6/1999 | Laurent | 400/242 |
| 2005/0115200 | A1 * | 6/2005 | Sung | 53/131.2 |
| 2006/0254210 | A1 * | 11/2006 | Yuyama et al. | 53/131.2 |
| 2008/0062240 | A1 * | 3/2008 | Sakurai et al. | 347/214 |
| 2008/0213023 | A1 * | 9/2008 | Koizumi et al. | 400/208 |

FOREIGN PATENT DOCUMENTS

| | | |
|---|---|---|
| EP | 1547770 | 6/2005 |
| KR | 10-0521720 | 10/2005 |

* cited by examiner

*Primary Examiner* — Daniel J Colilla
(74) *Attorney, Agent, or Firm* — Seed IP Law Group PLLC

(57) ABSTRACT

The present disclosure provides a printer for an automatic packing machine, which employs a ribbon cartridge to facilitate replacement of a ribbon tape and allows a thermal print head to be lifted or lowered to further facilitate replacement of the ribbon tape. The present disclosure also provides an automatic packing machine including the same. The printer is configured to print medicine data on a surface of a wrapping paper using a thermal print head and a ribbon tape. The printer includes a stationary plate secured to a lower portion of a body of the automatic packing machine, a movable plate disposed to be movable with respect to the stationary plate, and a ribbon cartridge receiving a ribbon tape and detachably mounted to the movable plate.

11 Claims, 11 Drawing Sheets

(Prior Art)

(a)

(b)

PRINTER FOR AUTOMATIC PACKING MACHINE AND METHOD OF CONTROLLING THE SAME

CROSS-REFERENCE TO RELATED APPLICATION

This application claims the benefit under 35 U.S.C. §119 of Korean Patent Application Nos. 10-2010-0052246 & 10-2010-0052247, filed on Jun. 3, 2010 in the Korean Intellectual Property Office, the entirety of which is incorporated herein by reference.

BACKGROUND

1. Technical Field

The present disclosure relates to a printer for an automatic packing machine and, more particularly, to a printer for an automatic packing machine and a method of controlling the same which employs a ribbon cartridge for providing a ribbon tape to facilitate replacement of the ribbon tape and allows a thermal print head to be lifted or lowered to further facilitate replacement of the ribbon tape, and which can adjust an unwinding speed of the ribbon tape through detection of a remaining amount of the ribbon tape during printing.

2. Description of the Related Art

Conventionally, an automatic packing machine receives medicine from a plurality of cassettes, which receive medicines such as tablets or capsules and consecutively packs the medicine into doses.

FIG. 1 is a schematic front view of a conventional automatic packing machine. Referring to FIG. 1, the automatic packing machine includes a body 100, a plurality of cassettes 110, which are arranged at an upper portion of the body 100 and receive medicines including tablets or capsules having various sizes and shapes, a hopper 130 disposed at a lower portion of the body 100 and collecting medicines discharged from the cassettes 110, a printer 140 for printing various medicine data on the surface of a wrapping paper for packing the medicines, and a packing machine 150 that packs the medicines using the wrapping paper when the medicines are collected in the hopper 130.

In such a conventional automatic packing machine, when medicines discharged from the cassettes 110 are collected in the hopper 130 and provided to a wrapping paper folded in half, the wrapping paper is passed through cylindrical bonding rollers provided with a heater to pack the medicines in a sealed state through thermal bonding of the wrapping paper. The packing machine is provided with a printer 140 to print data of the medicines on the wrapping paper.

Korean Patent No. 0521720 discloses one example of a conventional printer for an automatic packing machine. In this document, the printer prints medicine data on an outer surface of the wrapping paper using a thermal print head and a ribbon tape. At the moment of printing operation, the wrapping paper and the ribbon tape pass through the contact roller and the thermal print head while being stacked and compressed.

Here, since the ribbon tape is wound in a reel shape, the unwinding amount of the ribbon tape is changed according to the remaining amount of ribbon tape on a reel of the ribbon tape. That is, in an initial stage with 100% of the ribbon tape remaining on the reel, the amount of ribbon tape to be unwound by a single rotation of the reel is different from that of the ribbon tape to be unwound by a single rotation of the reel in a final stage with substantially 0% of the ribbon tape remaining on the reel.

However, since the conventional printer rotates the reel of the ribbon tape at a constant speed without considering the wound state of the ribbon tape around the reel, tension applied to the ribbon tape is not kept constant, causing deterioration of printing quality.

Further, when the ribbon tape is wound in the form of two reels, it is necessary to separate and mount these two reels at the same time upon replacement of the ribbon tape, making replacement inconvenient and providing a possibility of damage of the ribbon tape during replacement.

Furthermore, since the ribbon tape is interposed between the contact roller and the thermal print head, which are brought into close contact with each other to be compressed against each other by constant pressure, it is necessary for the printer to allow the thermal print head to be easily separated from the contact roller upon replacement of the ribbon tape.

BRIEF SUMMARY

The present disclosure is directed to solving the problems of the related art as described above, and an embodiment of the present disclosure provides a printer for an automatic packing machine which employs a ribbon cartridge to facilitate replacement of a ribbon tape and allows a thermal print head to be lifted or lowered to further facilitate replacement of the ribbon tape.

Further, the present disclosure provides a method of controlling a printer for an automatic packing machine, which can adjust an unwinding speed of a ribbon tape through detection of a remaining amount of the ribbon tape during printing.

In accordance with one aspect, a printer for an automatic packing machine prints medicine data on a surface of a wrapping paper using a thermal print head and a ribbon tape. The printer includes a stationary plate secured to a lower portion of a body of the automatic packing machine; a movable plate disposed to be movable with respect to the stationary plate; and a ribbon cartridge receiving a ribbon tape and detachably mounted to the movable plate.

The ribbon cartridge may be rotatably provided with a drive reel around which the ribbon tape is wound, and a driven reel from which the ribbon tape is unwound and released.

The movable plate may include a drive gear engaging with a rotational shaft of the drive reel and a driven gear engaging with a rotational shaft of the driven reel.

The drive gear may be connected to a drive motor and the driven gear may be connected to a tension motor.

The movable plate may be provided with a guide rod capable of guiding attachment/detachment of the ribbon cartridge, and the ribbon cartridge may be formed with a guide hole into which the guide rod is inserted.

The ribbon cartridge may be formed with a gripping portion to be gripped by a user upon attachment/detachment of the ribbon cartridge.

The movable plate may be provided with a sensor capable of detecting an attached state of the ribbon cartridge.

The stationary plate may be provided at a rear side thereof with a lifting motor for lifting or lowering the movable plate. The lifting motor includes a cam member formed on a rotational shaft thereof to push up a bearing on a rear side of the movable plate to move the movable plate.

When the cam member does not push the bearing upward by rotation of the lifting motor, the movable plate may be lowered by gravity.

A spring may be disposed between the stationary plate and the movable plate to assist in downward movement of the movable plate.

The stationary plate may be provided with a contact roller and the movable plate may be provided with the thermal print head to allow the ribbon tape to be interposed together with the wrapping paper between the thermal print head and the contact roller upon mounting of the ribbon cartridge, and the ribbon cartridge may be moved upwards or downwards together with the movable plate.

The printer further includes at least one guide member that guides movement of the movable plate with respect to the stationary plate.

The movable plate may be provided at a rear side thereof with a drive motor and a tension motor, which respectively drive the drive reel and the driven reel of the ribbon tape provided to the ribbon cartridge, and transmission members may be respectively disposed between the drive motor and the drive reel and between the tension motor and the driven reel to transmit drive force.

The printer may further include a ratchet mechanism including a ratchet member pivotally connected to the ribbon cartridge and having a pawl protruding from one side of the ratchet member, and serrated portions formed on the drive reel and the driven reel to engage with the pawl of the ratchet member.

In accordance with another aspect, a printer of an automatic packing machine prints medicine data on a surface of a wrapping paper using a thermal print head and a ribbon tape and includes a ribbon cartridge that receives the ribbon tape and is detachably installed inside the automatic packing machine.

In accordance with a further aspect, an automatic packing machine for consecutively packing various medicines into doses according to a prescription includes: a plurality of cassettes arranged at an upper portion of a body of the packing machine and receiving various sizes and shapes of medicines; a hopper disposed at a lower portion of the body and collecting the medicines discharged downwards from the cassettes; a printer printing various medicine data on a surface of a wrapping paper for packing medicines; and a packing unit that packs the medicines collected by the hopper using the wrapping paper. Here, the printer includes a ribbon cartridge that receives a ribbon tape and is detachably installed inside the body.

In accordance with yet another aspect, the present disclosure provides a method of controlling a printer for printing data of medicines on a surface of a wrapping paper in which medicines are packed by a thermal print head and a ribbon tape. The method includes measuring a remaining amount of the ribbon tape and adjusting an unwinding speed of the ribbon tape based on the measured remaining amount of the ribbon tape.

The measuring a remaining amount of the ribbon tape may include measuring the remaining amount of ribbon tape wound around a driven reel of the ribbon tape based on a rotating speed of the driven reel detected by an encoder provided to a rotational shaft of the driven reel, from which the ribbon tape is unwound and released.

The measuring a remaining amount of the ribbon tape may include rotating the drive motor to rotate a drive reel around which the ribbon tape is wound; allowing the ribbon tape to be unwound from the driven reel and rotate the driven reel as the ribbon tape is wound around the drive reel by rotation of the drive reel; and measuring the remaining amount of ribbon tape wound around the driven reel based on a rotating speed of the driven reel detected by the encoder provided to the rotational shaft of the driven reel.

The measuring a remaining amount of the ribbon tape may include measuring a pulse value based on rotation of the driven reel by detecting an encoder slit formed on the encoder through a sensor; and measuring the remaining amount of ribbon tape by comparing a frequency table stored in a controller with the measured pulse value.

The adjusting an unwinding speed of the ribbon tape may include adjusting the unwinding speed of the ribbon tape by controlling a rotational speed of a tension motor connected to the driven reel from which the ribbon tape is unwound and released.

The adjusting an unwinding speed of the ribbon tape may further include determining the rotational speed of the tension motor by comparing a tension table stored in a controller with the measured remaining amount of ribbon tape.

The rotational speed of the tension motor may be adjusted by increasing or decreasing the number of times of short circuit per unit time.

In accordance with yet another aspect, the present disclosure provides a method of controlling a printer for printing data of medicines on a surface of a wrapping paper, in which medicines are packed by a thermal print head and a ribbon tape. The method includes compressing a wrapping paper and a ribbon tape between the thermal print head and the contact roller; rotating a drive reel through rotation of a drive motor to allow the ribbon tape to be wound around the drive reel, so that the ribbon tape is unwound from a driven reel and rotates the driven reel; calculating, by a controller, a pulse value per unit time based on rotation of an encoder slit detected through a sensor by rotating an encoder provided to a rotational shaft of the driven reel; determining a remaining amount of the ribbon tape based on a pulse-remaining amount table stored in the controller; determining a torque value corresponding to the remaining amount of ribbon tape from a torque-remaining amount table stored in the controller; and increasing a rotational speed of a tension motor by reducing the number of times of short circuit per unit time of the tension motor connected to the driven reel according to the torque value.

DETAILED DESCRIPTION

Figure 1:
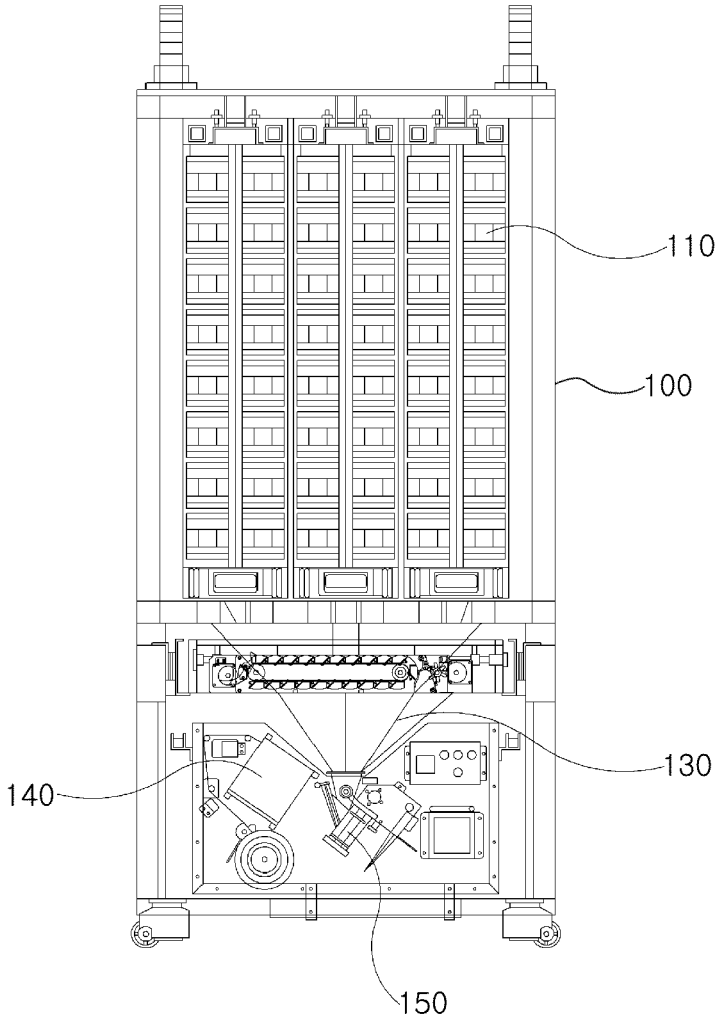
FIG. 1 is a schematic front view of a conventional automatic packing machine.

Hereinafter, embodiments of the present disclosure will be described in detail with reference to the accompanying drawings.

Referring to FIG. 2 to FIG. 8, a printer according to an embodiment is configured to print data of medicines on the surface of a wrapping paper in a packing machine which packs the medicines in the wrapping paper using a thermal print head 21 and a ribbon tape 31. Since a process of packing medicines in a wrapping paper or a process of printing medicine data on a wrapping paper using a thermal print head and a ribbon tape are the same as in, for example, in Korean Patent No. 0521720 and the like, detailed descriptions thereof will be omitted herein.

According to the embodiment, the printer includes a stationary plate 10 secured to a lower portion of a body of an automatic packing machine, a movable plate 20 disposed to be moved upwards or downwards with respect to the stationary plate 10, a ribbon cartridge 30 receiving a ribbon tape 31 and detachably mounted to the movable plate 20, and a thermal print head 21 coupled to the movable plate 20 and printing medicine data on a wrapping paper using the ribbon tape 31 while moving together with the movable plate 20.

The wrapping paper and the ribbon tape 31 are interposed in a stacked state between the thermal print head 21 and a contact roller 11, which is coupled to the stationary plate 10. Since the contact roller 11 is provided to the stationary plate 10 and the thermal print head 21 is provided to the movable plate 20, it is possible to increase a gap between the contact roller 11 and the thermal print head 21 by moving the movable plate 20 downwards when printing is not performed or when there is a need for replacement of the ribbon cartridge 30.

Figure 3:
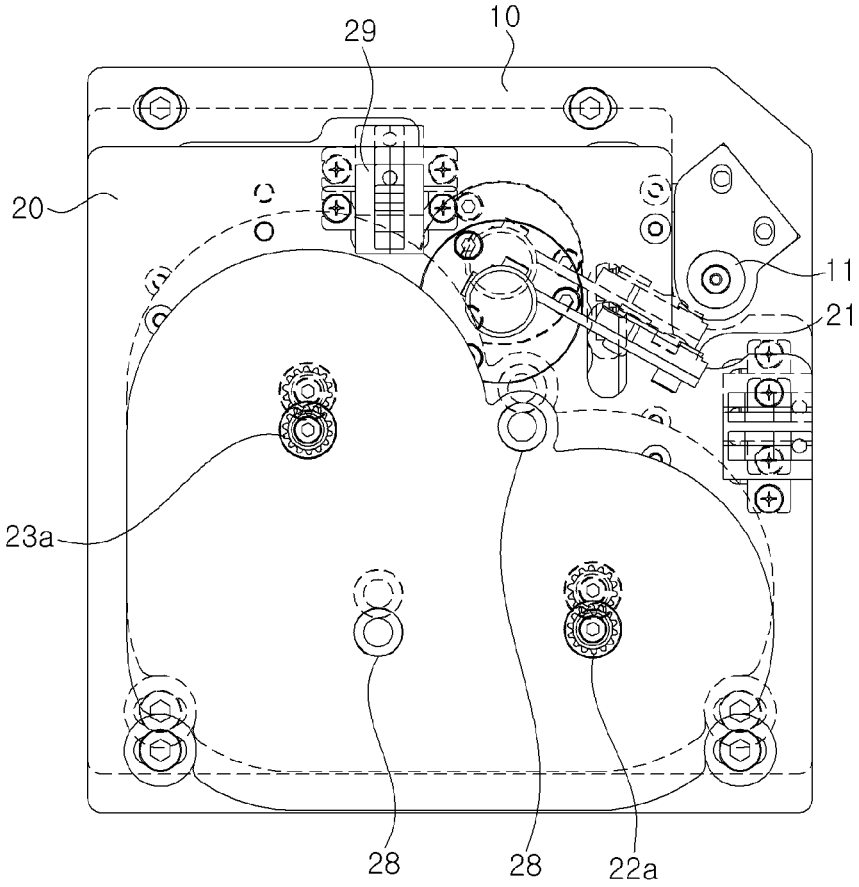
FIG. 3 is a front view of the printer, from which the ribbon cartridge is separated, according to the embodiment of the present disclosure.

FIG. 3 is a front view of the printer from which the ribbon cartridge 30 is removed, in which the movable plate 20 is indicated in a lowered state by a solid line and in a lifted state by a dotted line.

Figure 2:
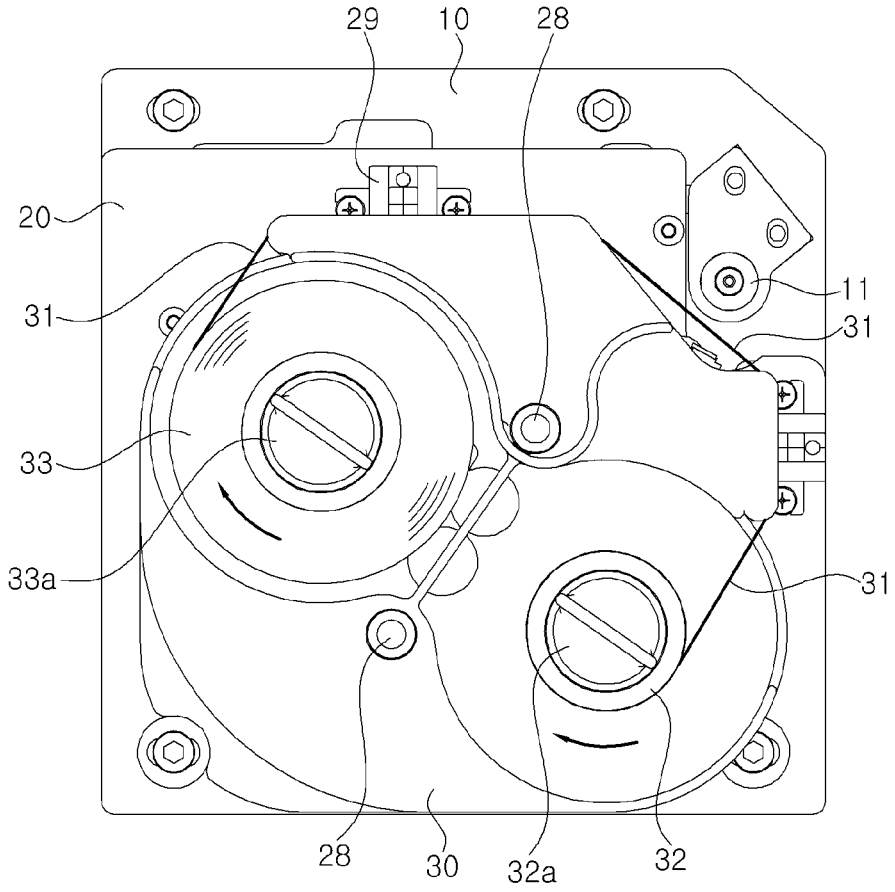
FIG. 2 is a front view of a printer including a ribbon cartridge according to an embodiment of the present disclosure.
Figure 4:
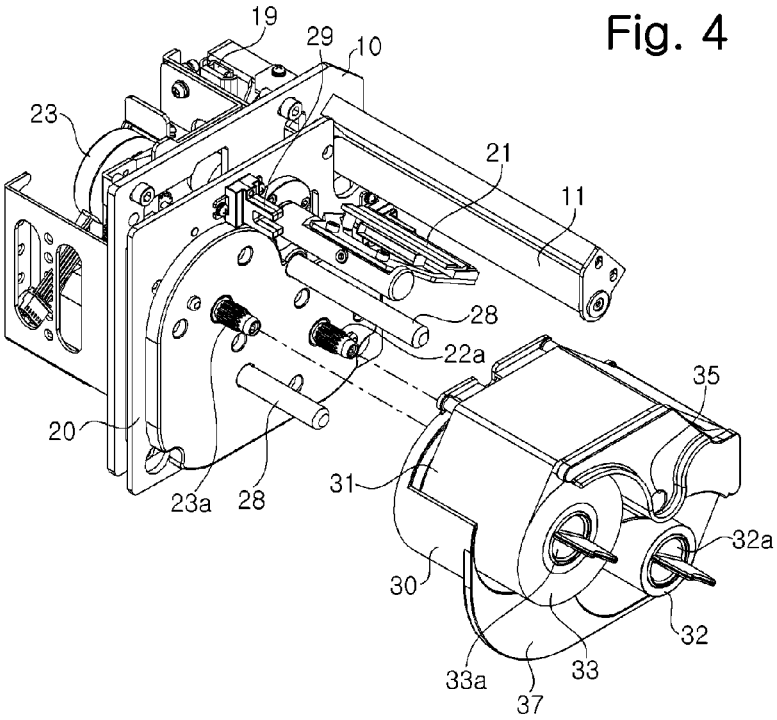
FIG. 4 is a perspective view of the printer according to the embodiment of the present disclosure.

As shown in FIG. 4, the ribbon cartridge 30 may be separated from the movable plate 20. Referring to FIGS. 2 and 4, tape reels, that is, a drive reel 32 and a driven reel 33, are rotatably mounted on the ribbon cartridge 30.

When the ribbon cartridge 30 is mounted on the movable plate 20, a rotational shaft 32*a* of the drive reel 32 may engage with a drive gear 22*a* of the movable plate 20 and a rotational shaft 33*a* of the driven reel 33 may engage with a driven gear 23*a* of the movable plate 20. The drive gear 22*a* is connected to a drive motor 22 through a transmission member, and the driven gear 23*a* is also connected to a tension motor 23 through a transmission member, as described below.

On the movable plate 20, at least one guide rod 28 may be mounted to guide detachment/attachment of the ribbon cartridge 30, and the ribbon cartridge 30 is formed with a guide hole 35 corresponding to each of the guide rods 28 such that each guide rod 28 can be inserted into the corresponding guide hole 35. When the guide rod 28 is mounted on the ribbon cartridge 30 through the guide hole 35, the ribbon tape 31 may be interposed between the thermal print head 21 and the contact roller 11.

The ribbon cartridge 30 may be formed with a gripping portion 37 for user convenience upon detachment/attachment of the ribbon cartridge 30. Although the gripping portion 37 is shown as having a flat plate shape in FIGS. 4 and 8, the gripping portion 37 may have various shapes that allow a user to easily grip the ribbon cartridge therethrough.

The ribbon cartridge 30 may be detached from or attached to the movable plate 20 after the movable plate 20 is moved downwards. According to this embodiment, since the entirety of the movable plate 20 is moved up or down with respect to the stationary plate 10 as described below, detachment/attachment of the ribbon cartridge 30 can be easily achieved.

On the other hand, the movable plate 20 is provided with a sensor 29 for detection of detachment/attachment of the ribbon cartridge 30. Any kind of sensor may be used as the sensor 29 so long as the sensor can detect whether the ribbon cartridge 30 is suitably mounted.

Figure 5:
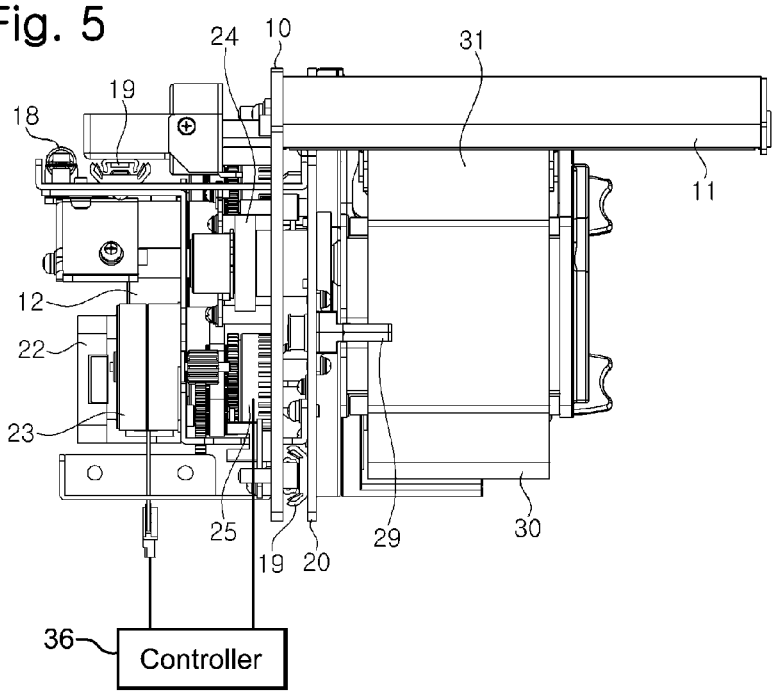
FIG. 5 is a plan view of the printer according to the embodiment of the present disclosure.
Figure 6:
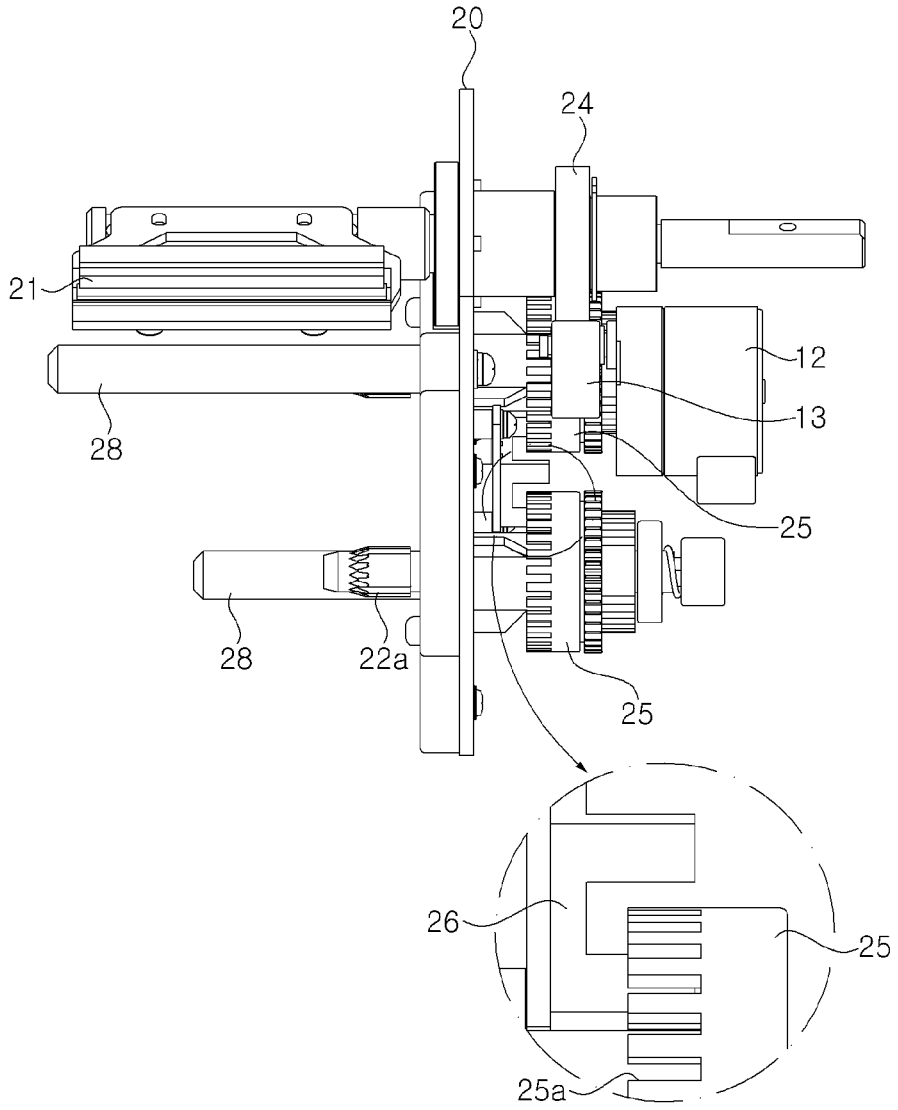
FIG. 6 is a side view of a main part of the printer according to the embodiment of the present disclosure.
Figure 7:
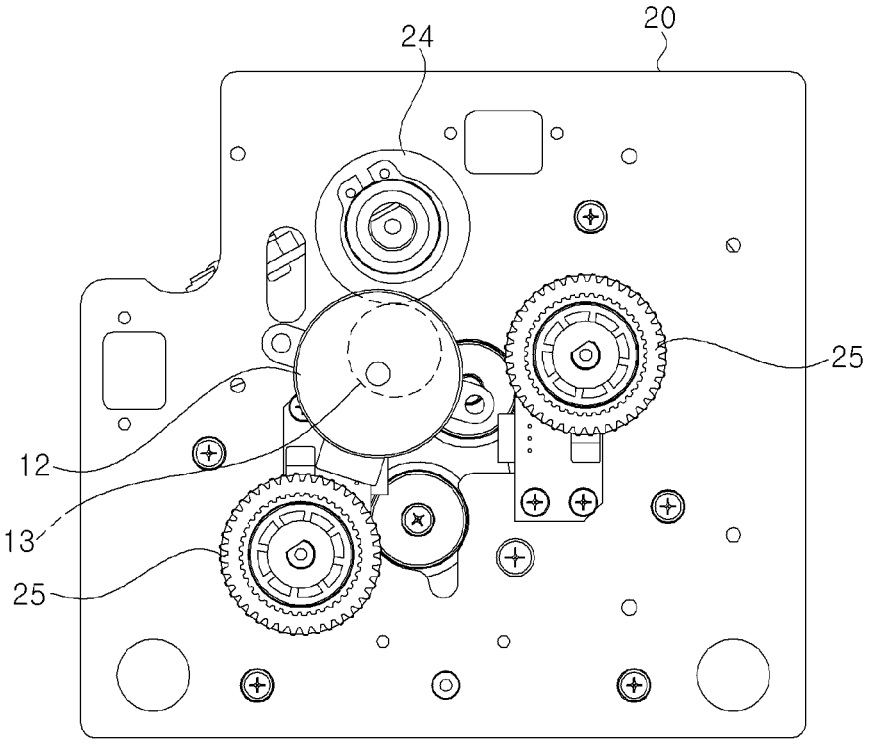
FIG. 7 is a rear view of a main part of the printer according to the embodiment of the present disclosure.
Figure 8:
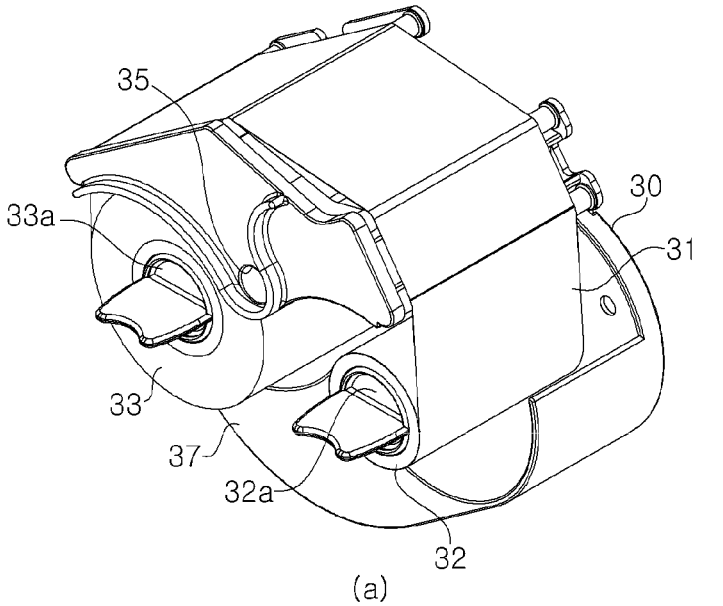
FIG. 8 is a perspective view of the ribbon cartridge of the printer according to the embodiment of the present disclosure.
Figure 8:
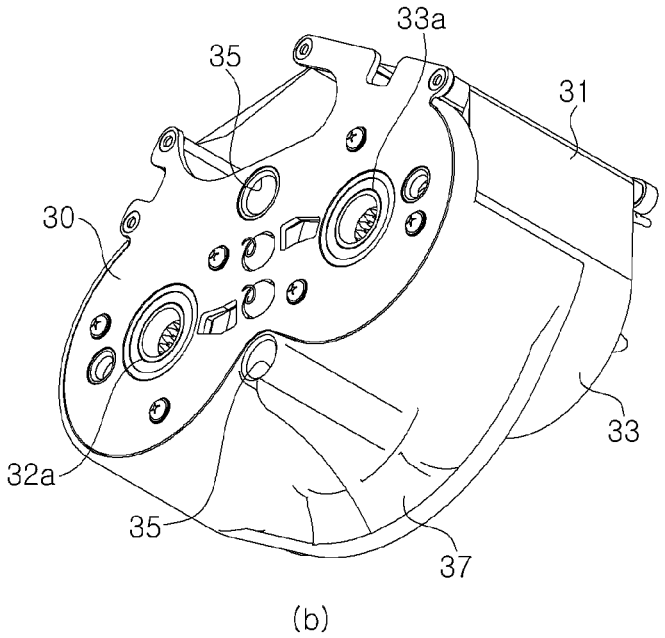

As shown in FIGS. 5 and 6, the stationary plate 10 is provided at a rear side thereof with a lifting motor 12 for lifting or lowering the movable plate 20. FIGS. 6 and 7 show the printer from which the stationary plate 10 is removed for explaining operation of the lifting motor 12. Lifting or lowering the movable plate 20 is achieved by rotating a cam member 13 coupled to the rotational shaft of the lifting motor 12, as shown in FIG. 6. As the cam member 13 is rotated, the cam member 13 pushes up a bearing 24, which is coupled to the movable plate 20, to move the movable plate 20 upwards. When the cam member 13 is further rotated, the movable plate 20 is moved downwards by gravity. Here, to assist in downward movement of the movable plate, a spring 18 may be disposed between the stationary plate 10 and the movable plate 20. At least one guide member 19 may be provided to guide the upward or downward movement of the movable plate 20 with respect to the stationary plate 10.

The movable plate 20 is provided at the rear side thereof with the drive motor 22 and the tension motor 23 for driving the tape reels, that is, the drive reel 32 and the driven reel 33, which are mounted on the ribbon cartridge 30. A transmission member such as a belt or gear may be disposed between the drive motor 22 and the drive reel 32 to transmit drive force from the drive motor 22 to the drive reel 32. Further, another transmission member such as a belt or gear member may be disposed between the tension motor 23 and the driven reel 33 to transmit drive force from the tension motor 23 to the driven reel 33.

Encoders 25 are provided to the rotational shafts of the drive reel 32 and the driven reel 33 to convert rotation of these reels into pulses. As shown in FIG. 6, the sensor 26 may count revolutions (rotating angle) of an encoder slit 25*a*, which can be used to determine the remaining amount of ribbon tape.

Figure 9:
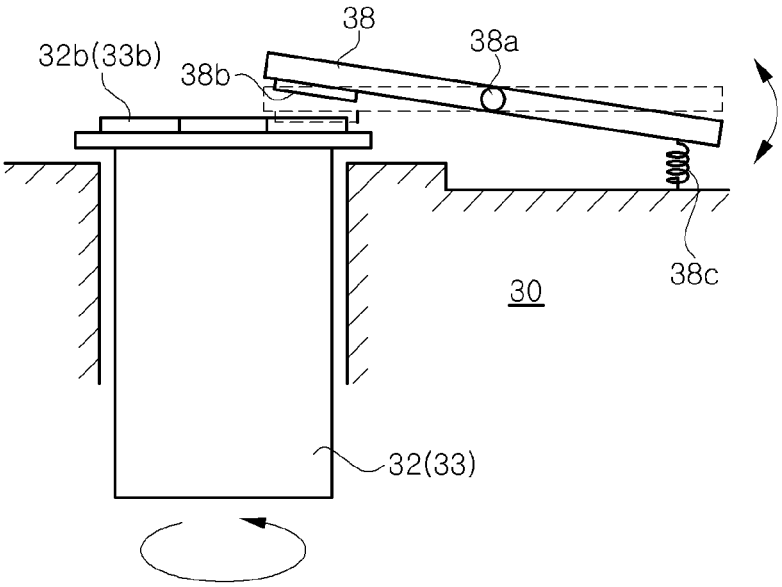
FIG. 9 is a view of a ratchet mechanism included in the ribbon cartridge of the printer according to the embodiment of the present disclosure.
Figure 9:
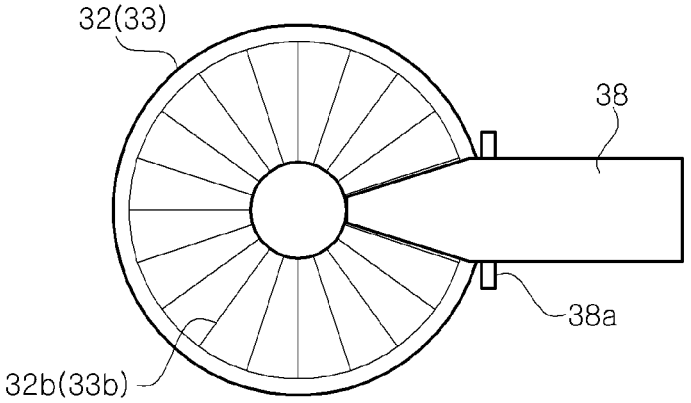

FIG. 9 is a schematic structure of a ratchet mechanism that allows the drive reel 32 or the driven reel 33 to be rotated only in one direction such that the ribbon tape has constant tension, in which (a) is a schematic side view of the ratchet mechanism and (b) is a schematic plan view of the ratchet mechanism. The ratchet mechanism makes it possible to prevent the ribbon tape from being loosely stretched after the drive reel 32 or the driven reel 33 is mounted on the ribbon cartridge 30.

Referring to FIG. 9, the ratchet mechanism includes a ratchet member 38 pivotally mounted on the ribbon cartridge 30 and having a pawl 38*b* protruding from one side of the ratchet member 38, and serrated portions 32*b*, 33*b* formed on the drive reel 32 and the driven reel 33 to engage with the pawl 38*b* of the ratchet member.

Each of the serrated portions 32*b*, 33*b* and the pawl 38*b* has a tooth shape inclined in one direction as in a general ratchet mechanism, and thus a detailed description thereof will be omitted.

As shown by a dotted line in FIG. 9(*a*), the ratchet member 38 is kept in a compressed state by a resilient member 38*c* such that the pawl 38*b* and the serrated portions 32*b*, 33*b* are brought into contact each other. When the ratchet member 38 is in a compressed state, the drive reel 32 and the driven reel 33 can be rotated only in one direction and are prevented from being freely rotated.

When the ribbon cartridge 30 is mounted on the movable plate 20 of the printer, the ribbon cartridge 30 compresses the ratchet member 38 and forces a protrusion (not shown) formed on the movable plate to compress the resilient member 38*c*. As the ratchet member is rotated about a hinge shaft 38*a*, the pawl 38*b* and the serrated portions 32*b*, 33*b* may be disengaged from each other. As a result, when the ribbon cartridge 30 is mounted on the movable plate 20 of the printer, the drive reel and the driven reel can be freely rotated by the drive motor and the tension motor.

Figure 10:
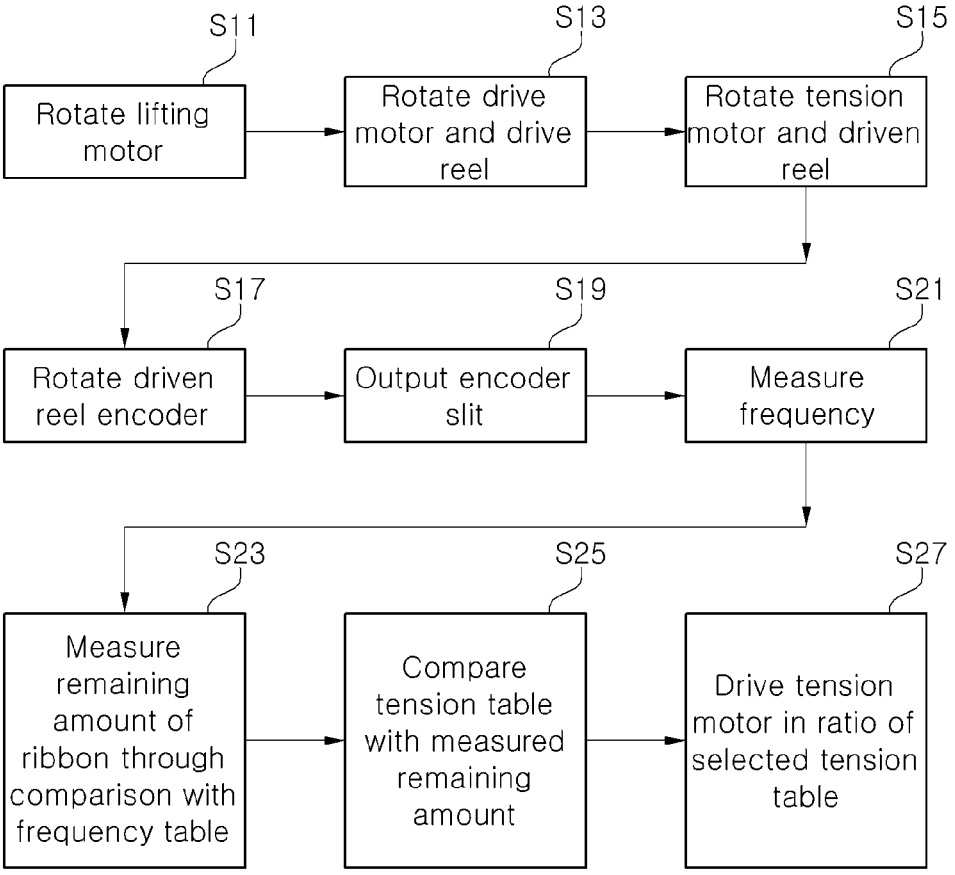
FIG. 10 is a block diagram illustrating a method of controlling a printer according to an embodiment of the present disclosure.

Next, a method of controlling the printer for an automatic packing machine according to an embodiment will be described with reference to FIGS. 10 to 12.

In operation of the printer to print medicine data on the surface of a wrapping paper, the lifting motor 12 is driven to lift the movable plate 20. At this time, the thermal print head 21 coupled to the movable plate 20 is brought into contact with the contact roller 11 to press the wrapping paper and a ribbon tape positioned therebetween with suitable pressure (S11).

Then, when the drive reel 32 is rotated by rotation of the drive motor 22, the ribbon tape 31 is wound around the drive reel 32 (S13), a ribbon tape 32 is unwound from the driven reel 33 and rotates the driven reel 33 and the tension motor 23 (S15).

As the driven reel 33 is rotated, the encoder 25 coupled to the rotational shaft of the driven reel 33 is rotated (S17), and rotation of the encoder slit 25*a* is detected by the sensor 26, which in turn sends a detection signal to a controller 36 (FIG. 5) to output a pulse value per unit time (S19). Then, a pulse frequency is measured based on the output pulse value (S21).

Figure 11:
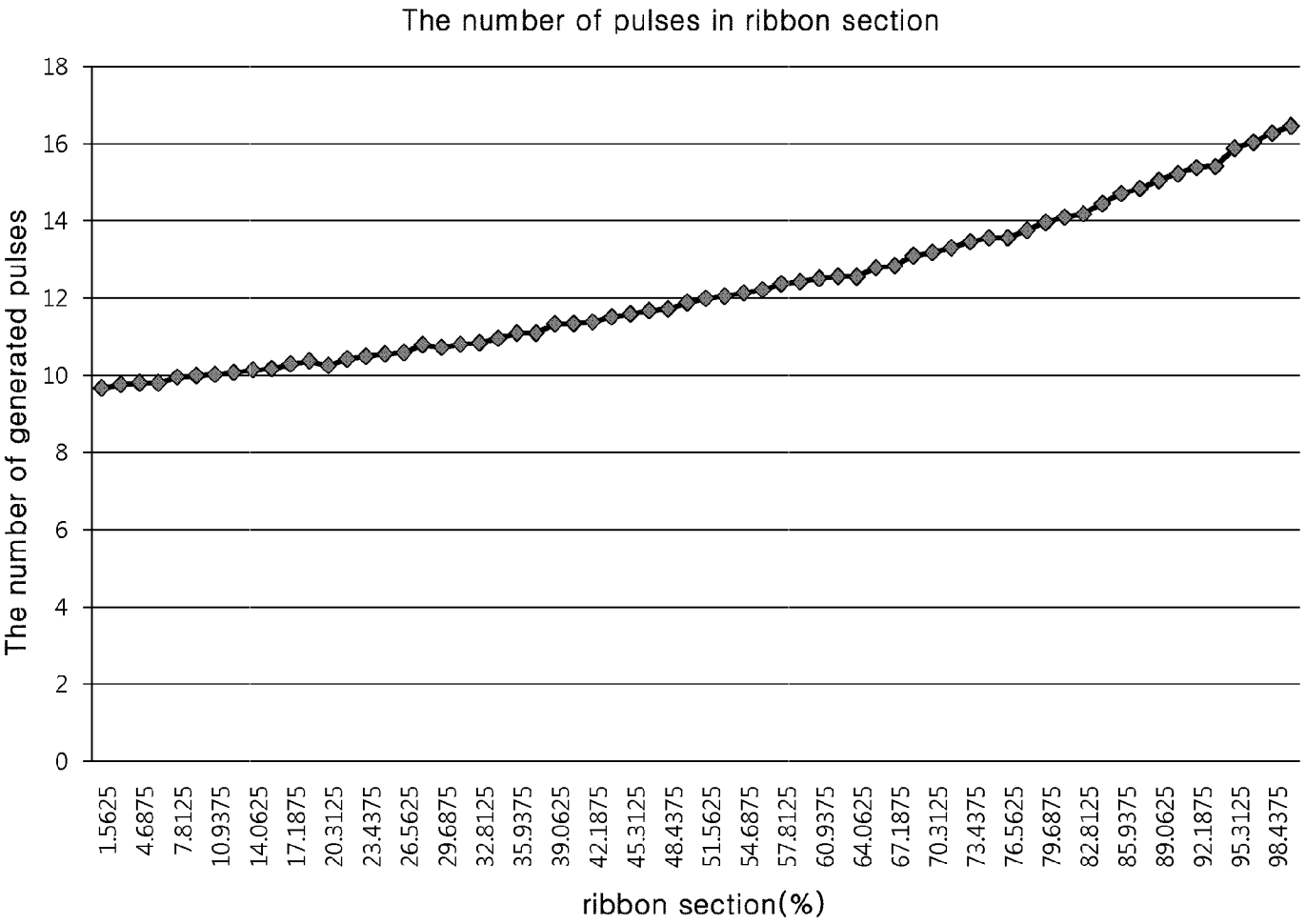
FIG. 11 is a graph for detecting the remaining amount of ribbon tape in a printer according to an embodiment of the present disclosure.

Then, the remaining amount of ribbon tape is measured in terms of percent (%) by comparing the measured frequency with a frequency table stored in the controller 36, as shown in FIG. 11 (S23).

Figure 12:
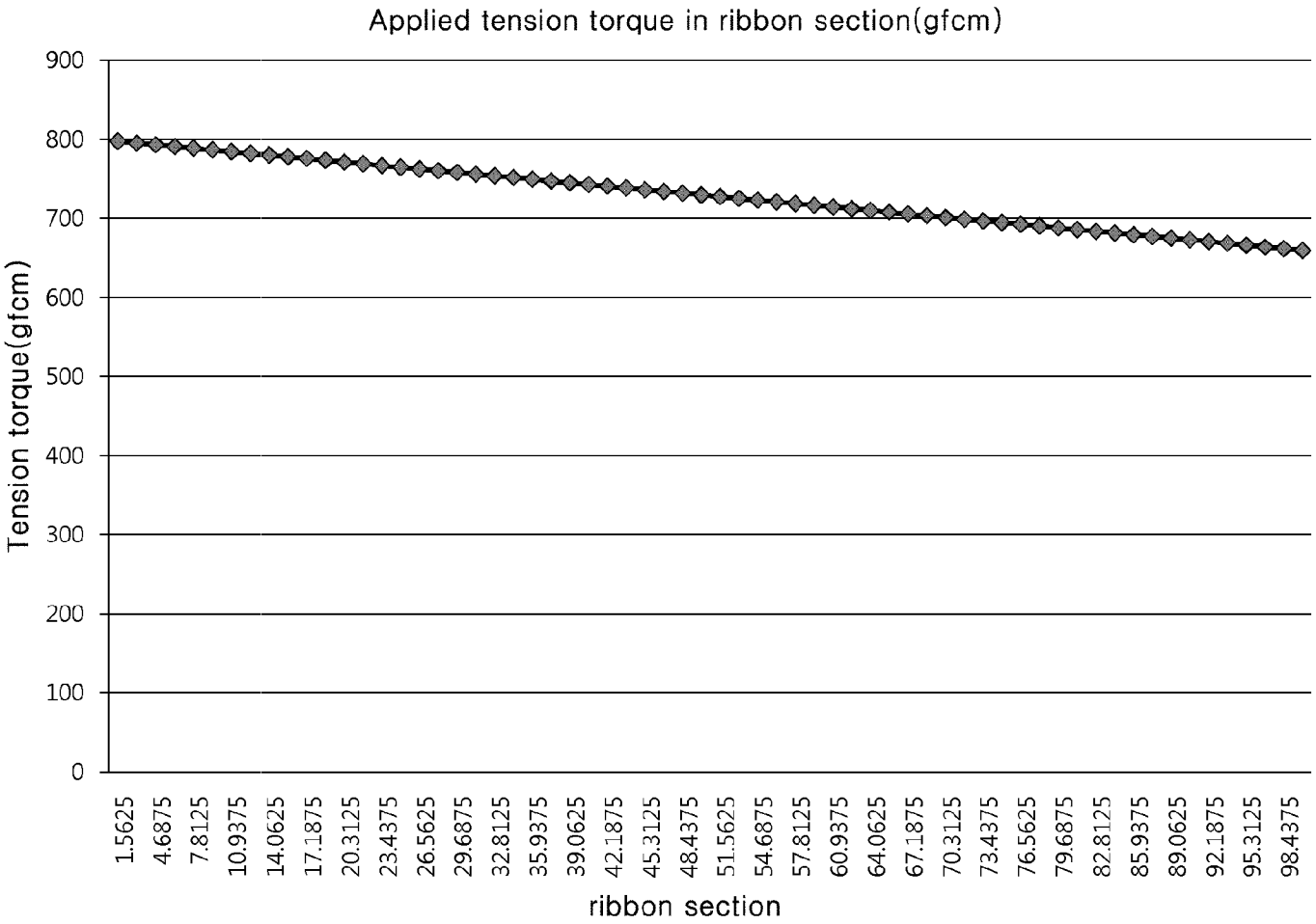
FIG. 12 is a graph for adjusting the degree of unwinding according to the detected remaining amount of ribbon tape in a printer according to an embodiment of the present disclosure.

Then, rotation of the tension motor 23 is controlled by determining suitable tension torque from a tension table also stored in the controller 36, as shown in FIG. 12, based on the measured remaining amount of ribbon tape (S27).

Rotation of the tension motor 23 is controlled by increasing or decreasing the number of times of short circuit per unit time using characteristics of the motor 23 which acts as a generator upon short circuit of power. When the number of times of short circuit per unit time increases, the tension motor 23 acts as a generator for extended time and obstructs free movement of the driven reel 33, thereby reducing the amount of ribbon tape unwound from the driven reel 33.

Herein, it should be noted that the numerals in the tables shown in FIGS. 11 and 12 are provided for illustrative purpose in a specific ribbon tape reel and may be modified in various ways, as needed.

As such, the embodiments of the present disclosure provide a printer of an automatic packing machine, which employs a ribbon cartridge for providing a ribbon tape and allows a thermal print head to be lifted or lowered, and an automatic packing machine including the same.

With this configuration, the printer according to the embodiments may facilitate replacement of the ribbon tape.

Further, the embodiments of the present disclosure provide a method of controlling a printer for an automatic packing machine, which can adjust an unwinding speed of a ribbon tape through detection of a remaining amount of the ribbon tape during printing.

Accordingly, the method according to the embodiments may adjust the unwinding speed of the ribbon tape so that the amount of ribbon tape unwound from a ribbon tape reel can be adjusted, thereby improving print quality.

The various embodiments described above can be combined to provide further embodiments. All of the patents, patent application publications, patent applications, foreign patents, foreign patent applications and non-patent publications referred to in this specification and/or listed in the Application Data Sheet are incorporated herein by reference in their entirety. Aspects of the embodiments can be modified, if necessary, to employ concepts of the various patents, applications and publications to provide yet further embodiments.

These and other changes can be made to the embodiments in light of the above-detailed description. In general, in the following claims, the terms used should not be construed as limiting the claims to the specific embodiments disclosed in the specification and the claims, but should be construed as including all possible embodiments along with the full scope of equivalents to which such claims are entitled.

Accordingly, the claims are not limited by the disclosure.

The invention claimed is:

1. A printer for an automatic packing machine which prints medicine data on a surface of a wrapping paper using a thermal print head and a ribbon tape, the printer comprising:

a stationary plate secured to a lower portion of a body of the automatic packing machine;

a movable plate disposed to be movable with respect to the stationary plate;

a ribbon cartridge receiving the ribbon tape and detachably mounted to the movable plate, the ribbon cartridge including a first reel around which the ribbon tape is wound and a second reel from which the ribbon tape is unwound and released;

a drive motor provided at a rear side of the movable plate which drives the first reel to draw the ribbon tape from the second reel;

a tension motor provided at the rear side of the movable plate which drives the second reel, an unwinding speed of the ribbon tape being adjusted by controlling a rotational speed of the tension motor; and a controller that adjusts the rotational speed of the tension motor by controlling the number of times of short circuits per unit time of the tension motor connected to the second reel based on corresponding remaining amounts of the ribbon tape on the second reel while the drive motor drives the first reel to draw the ribbon tape from the second reel, wherein when the first reel is rotated by rotation of the drive motor, the ribbon tape is wound around the first reel so that the ribbon tape which is unwound from the second reel rotates the second reel and the tension motor, and wherein when the tension motor is shorted, the tension motor acts as a generator and obstructs free rotation of the second reel, thereby reducing the amount of ribbon tape unwound from the second reel.

2. The printer of claim 1, wherein the movable plate is provided with a guide rod capable of guiding attachment/detachment of the ribbon cartridge, and the ribbon cartridge is formed with a guide hole into which the guide rod is inserted.

3. The printer of claim 1, wherein the ribbon cartridge is formed with a gripping portion to be gripped by a user upon attachment/detachment of the ribbon cartridge.

4. The printer of claim 1, wherein the movable plate is provided with a sensor capable of detecting an attached state of the ribbon cartridge.

5. The printer of claim 1, wherein the stationary plate is provided at a rear side thereof with a lifting motor for lifting or lowering the movable plate, the lifting motor comprising a cam member formed on a rotational shaft thereof to push up a bearing on a rear side of the movable plate to move the movable plate.

6. The printer of claim 1, wherein the stationary plate is provided with a contact roller and the movable plate is provided with the thermal print head to allow the ribbon tape to be interposed together with the wrapping paper between the thermal print head and the contact roller upon mounting of the ribbon cartridge, the ribbon cartridge being moved upwards or downwards together with the movable plate.

7. The printer of claim 1, further comprising: at least one guide member that guides movement of the movable plate with respect to the stationary plate.

8. The printer of claim 1, wherein transmission members are respectively disposed between the drive motor and the first reel and between the tension motor and the second reel to transmit drive force.

9. The printer of claim 1 wherein the controller is configured to adjust the rotational speed of the tension motor by controlling the number of times of short circuits per unit time of the tension motor connected to the second reel based on corresponding remaining amounts of the ribbon tape on the second reel by comparing a measured frequency associated with rotation of the second reel with a frequency table.

10. A printer of an automatic packing machine that prints medicine data on a surface of a wrapping paper using a thermal print head and a ribbon tape, the printer comprising:

a ribbon cartridge that receives the ribbon tape and is detachably installed inside the automatic packing machine, the ribbon cartridge including a first reel around which the ribbon tape is wound and a second reel from which the ribbon tape is unwound and released;

a drive motor which drives the first reel to draw the ribbon tape from the second reel;

a tension motor which drives the second reel, an unwinding speed of the ribbon tape being adjusted by controlling a rotational speed of the tension motor; and a controller that adjusts the rotational speed of the tension motor by controlling the number of times of short circuits per unit time of the tension motor connected to the second reel based on corresponding remaining amounts of the ribbon tape on the second reel while the drive motor drives the first reel to draw the ribbon tape from the second reel, wherein when the first reel is rotated by rotation of the drive motor, the ribbon tape is wound around the first reel so that the ribbon tape which is unwound from the second reel rotates the second reel and the tension motor, and wherein when the tension motor is shorted, the tension motor acts as a generator and obstructs free rotation of the second reel, thereby reducing the amount of ribbon tape unwound from the second reel.

11. The printer of claim 10 wherein the controller is configured to adjust the rotational speed of the tension motor by controlling the number of times of short circuits per unit time of the tension motor connected to the second reel based on corresponding remaining amounts of the ribbon tape on the second reel by comparing a measured frequency associated with rotation of the second reel with a frequency table.

* * * * *